US005553855A

United States Patent [19]

Balestrieri

[11] Patent Number: 5,553,855

[45] Date of Patent: Sep. 10, 1996

[54] FOOTBALL KICKING PRACTICE DEVICE

[75] Inventor: Harry Balestrieri, Plantation, Fla.

[73] Assignee: M. R. Carretta Co., Inc., Allamuchy, N.J.

[21] Appl. No.: 299,734

[22] Filed: Sep. 1, 1994

[51] Int. Cl.[6] ..... A63B 69/00

[52] U.S. Cl. ..... 273/55 B

[58] Field of Search ..... 273/55 B

[56] References Cited

U.S. PATENT DOCUMENTS 4,477,077 10/1984 Ferrebee ..... 273/55 B 4,546,974 10/1985 Brown ..... 273/55 B 4,946,165 8/1990 Rambacher ..... 273/55 B

*Primary Examiner*—V. Millin

*Assistant Examiner*—Charles W. Anderson

*Attorney, Agent, or Firm*—Lerner, David, Littenberg, Krumholz & Mentlik

[57] ABSTRACT

Football holding devices for assisting in place kicking football are disclosed, including a stand and a pivotable arm attached to the top of the stand, in which the pivotable arm can pivot from first position in which it holds the football in its proper place kicking configuration, and a second vertical position.

19 Claims, 5 Drawing Sheets

FOOTBALL KICKING PRACTICE DEVICE

FIELD OF THE INVENTION

The present invention relates to football holding devices. More particularly, the present invention relates to devices for assisting in training football kickers. Still more particularly, the present invention relates to a football holder for place kicking which simulate a person holding the football.

BACKGROUND OF THE INVENTION

In playing the game of football, from the sandlot level to the professional ranks, the art of place kicking is a significant element in the scoring process. Football place kickers thus spend many hours honing their skills by practicing place kicking in order to develop both the strength and accuracy to do so at a proficient level. In the past, however, it has been necessary to utilize a second person to hold the football, as is the case during game conditions, thus preventing the kicker from practicing on his own. For that reason, a number of devices for holding the football have been developed in the past.

These devices include, for example, the device shown in U.S. Pat. No. 4,946,165 to Rambacher. This device includes a base, a vertical stem, and a pivotable arm adapted to hold the football from one end thereof, so that it may be retained in a proper position for place kicking. The device shown in Rambacher is quite complicated, and includes an adjustable tensioning mechanism to control the amount of tension applied to the football as it is being held. This device thus specifically includes a horizontal holding arm 16 for holding the football in the manner shown in FIG. 1 thereof. This device also includes a specific mechanism to prevent holding arm 16 from pivoting downwardly into a vertical position; namely, a stop member 120 shown in FIG. 3 thereof. Furthermore, in view of the horizontal position of arm 16, the Rambacher device also includes an adjustable tensioning mechanism which is controlled by turning knob 184 to cause screw 182 to move up or down within aperture 150 of stop member 120. This, in turn, adjusts the tension provided by holding arm 16. With all tension removed, the lowest possible position of holding arm 16 is shown in FIG. 4 of Rambacher, and is relatively close to horizontal. Furthermore, the device is specifically designed to be adjusted for use with a particular size of football, and if it is desired to use this device with a different-sized football, it must be carefully readjusted.

Another football holding device is disclosed in U.S. Pat. No. 4,546,974 to Brown. This device is intended to accommodate footballs of different sizes, and in a manner which does not interfere with the flight of the ball after it is kicked. It thus includes springs or other elastic-type members to cause the holding arm to swing up and away from the path of the kicker's foot after the kicking process has been initiated. In this case, the height of the device is adjusted by knob 46 as shown in FIG. 1 thereof, thus permitting telescoping member 44 to be raised or lowered to a desired height; i.e., to a specific level for each size of football to be utilized. In operation, movement of the football, and of the kicker's foot, is intended to force holding arm 16 out of the detent formed by overhanging portion 64 of positioning member 60. Thus, elastic member 76 is intended to pull the holding arm 16 upwardly in the direction of arrow 82 out of the football kicker's path. This, again, requires a rather complex mechanism, which is nevertheless not a foolproof one.

A number of additional football holding devices are also known, each of which includes a holding arm placed above a base whose other end is intended to contact the end of a football. These include U.S. Pat. No. 4,632,395 to Ferrebee, which includes an arm consisting of three elements pivotally connected serially to each other. Thus, even though each of the elements may be made of rigid materials, the device is claimed to be rather unrigid because of the multi-adjustable pivotal connections between the elements thereof. Thus, the device is intended to fall to the side upon kicking and therefore not interfere with the kicker's foot.

Additionally, U.S. Pat. No. 4,634,122 to Kline discloses another football holding device, which in this case includes a holding member which includes an arm 16, to which is attached a flexible finger 18, as well as a tension adjustment means 20 in the form of a cylindrical weighted body which is movable along the arm 16. In this case, it is also noted that the football is held in position on a kicking tee 24.

U.S. Pat. No. 3,897,948 to Gerela discloses yet another football place kicking device which in this case simply includes supporting shaft 6 on a base 4 and a tubular flexible arm 18 which is received in a reduced cross-section 16 of the shaft. Arm 18 in this case is said to be made of a semi-rigid material, meaning that it is deformable but will resume its original shape. A plastic garden hose is specifically referred to therein.

Finally, U.S. Pat. No. 4,807,880 to Deal discloses yet another such device, in this case including a J-spike having a rigid permanent configuration as shown in FIG. 1 thereof.

The search has therefore continued for a simpler, more effective football holding device, which, at the same time, not only provides for realistic simulation of a person holding the football, but also does so in an extremely simple manner, which does not interfere with the kicker, and which provides proper holding and placement of the football for repetitive, authentic use.

SUMMARY OF TM INVENTION

These and other objects have now been accomplished by the invention of a football holding device for assisting in place kicking a football comprising stand means having a lower end for stable placement on the ground, and an upper end, and a pivotable arm pivotally attached to the upper end of the stand means, the pivotal arm having a first end and a second end, the first end of the pivotable arm being pivotally attached to the upper end of the stand means, and the second end of the pivotable arm being adapted for frictional engagement with one end of the football so as to maintain the football at a proper place kicking configuration, the pivotal arm rigidly extending from the first end to the second end, and being freely swingable between a first position in which the pivotable arm extends substantially horizontally and a second position in which the pivotable arm extends vertically downwardly, whereby the pivotable arm may hold the football in its place kicking configuration in the first position, and can freely swing downwardly to the second position under the force of gravity upon the football being kicked.

In accordance with one embodiment of the football holding device of the present invention, the distance between the upper and lower ends of the stand means is greater than the length of the football, whereby the first position of the pivotable arm is displaced downwardly from the horizontal by an acute angle, thereby permitting the force of gravity to assist in holding the football in the place kicking configuration. Preferably, the acute angle is between about 1° and 10° below horizontal.

In accordance with another embodiment of the football holding device of the present invention, the pivotable arm includes a first portion and a second portion angularly displaced with respect to the first portion, the first portion of the pivotable arm including pivotal attachment means for pivotal attachment to the upper end of the stand means, and a second portion of the pivotable arm comprises the major portion of the pivotable arm, and extends vertically downwardly when the pivotable arm is in the second position.

In accordance with another embodiment of the football holding device of the present invention, the stand means includes height adjustment means for varying the distance between the upper and lower ends of the stand means, whereby the distance between the upper and lower ends of the stand means may be greater than the length of the football, and the first position of the pivotable arm is displaced downwardly from the horizontal by an acute angle, thereby permitting the force of gravity to assist in holding the football in its place kicking configuration. Preferably, the height adjustment means comprises telescoping first and second stand members and locking means for locking the first and second stand members in a desired position relative to each other.

In accordance with another embodiment of the football holding device of the present invention, the lower end of the stand means comprises a tripod. In another embodiment, the lower end of the stand means includes a plurality of leg members, and preferably the plurality of leg members are pivotable between an open position in which the football holding device can be in a stable placement on the ground and a storable closed position.

In accordance with another embodiment of the football holding device of the present invention, the second end of the pivotable arm includes friction tip means for frictionally engaging the football.

BRIEF DESCRIPTION OF THE DRAWINGS

The present invention may be more fully appreciated with reference to the following detailed description, in which reference is made to the Figures, in which.

DETAILED DESCRIPTION

Figure 1:
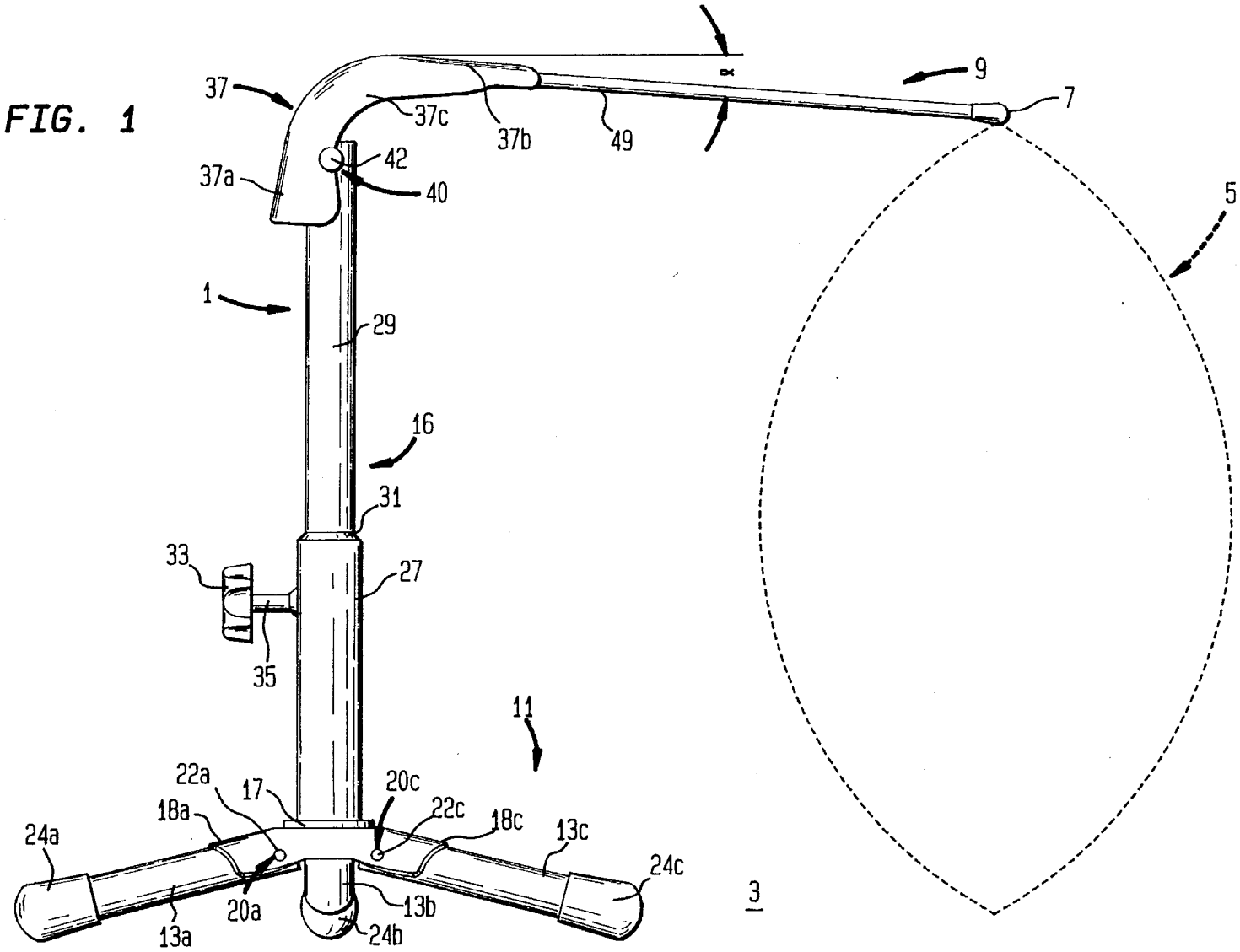
FIG. 1 is a side, elevational view of the football holding device of the present invention in conjunction with a football as shown in phantom view therein.

Referring to the drawings, in which like reference numerals refer to like portions thereof, FIG. 1 shows a football holding device 1 in accordance with this invention in its open position stabilized on the ground 3 and in conjunction with a football 5 also on the ground 3, and in its proper place kicking configuration. It is understood in this regard that the precise placement of the football 5 with respect to the football holding device 1 can be varied to the extent that the angle of the major axis of the football with respect to the ground 3 can be somewhat varied in accordance with the preference of the kicker himself. In any event, in its proper stable configuration, the football extends from the ground 3 to a frictional tip 7 at the end of a pivotable arm 9 which is discussed in more detail below.

The football holding device 1 itself is placed on the ground 3 in a stable configuration by means of tripod 11 comprising three legs 13*a, b* and *c*. Each of these legs 13*a*, *b* and *c* is pivotally attached to a central leg connecting member 15. Thus, the central leg connecting member 15 includes a central annular portion 17 attached to the low end of the upstanding portion 16, and three radially extending connecting portions 18*a, b* and *c*, each of which has a generally semicircular cross-section with a degree of curvature adapted to mate with each of the legs 13*a, b* and *c* in the manner shown in FIG. 1. Each of these legs 13*a, b* and *c* is then pivotally connected to the radially extending connecting portions 18*a, b* and *c* of the central connecting member 15 at pivot points 20*a, b* and *c*, comprising rivets 22*a, b* and *c* extending through corresponding apertures in each of the radially extending connecting portions 18*a, b* and *c* and legs 13*a, b* and *c*. The opposite ends of each of the legs 13*a, b* and *c* include rubber gripper pads 24*a, b* and *c* at the ends thereof for further stabilizing each of these legs and the overall stand on the ground 3.

Figure 3:
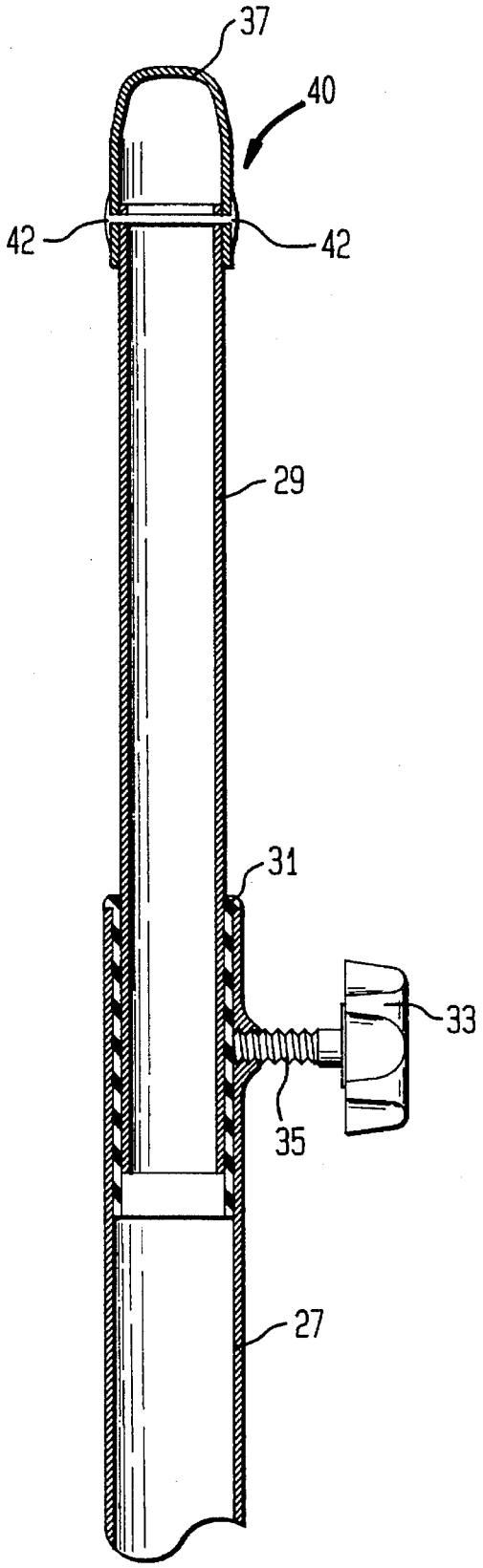
FIG. 3 is a rear, elevational, partial sectional view of a portion of the football holding device shown in FIG. 1.

The upstanding portion 16 of the stand itself projects upwardly from the tripod 11. Thus, the upstanding portion 16 essentially comprises two telescoping cylindrical members 27 and 29. Cylindrical member 27 extends upwardly and is affixed to the central annular portion 17 of the central leg connecting member 15. Telescopically retained within cylindrical member 27 is second cylindrical member 29, which is telescopically extendable therefrom. Thus second cylindrical member 29 is slidably engaged within an annular collar 31 which is engageably set within the upper end of cylindrical member 27. After telescopic adjustment of the second cylindrical member 29 to a desired position or height such as that shown in FIG. 1, a mechanism is included for locking the first and second cylindrical members 27 and 29 into their desired relative positions. This includes knob 33 with extending threaded member 35 for frictionally engaging collar 31 and pressing same against second cylindrical member 29 so as to temporarily lock it in its desired position. Specific reference in this regard is made to FIG. 3, which demonstrates this interrelationship between these telescoping members.

At the upper end of the second cylindrical member 29 pivotable arm 9 is pivotally connected thereto. Pivotable arm 9 includes a curved portion 37 which extends in a generally 90° turn from a first portion 37*a* to a second portion 37*b* through a central arcuate portion 37*c*. The first portion 37*a* has a generally semi-circular cross-section, so as to be pivotable with the outer surface of the second cylindrical member 29, thus having a degree of curvature generally corresponding thereto. First portion 37*a* is pivotally connected to the upper end of second cylindrical member 29 at pivot point 40 by means of a rivet 42 extending through corresponding apertures in the first portion 37*a* of the pivotable arm 9 and in the upper portion of the second cylindrical member 29. The second end 37*b* of the curved portion 37 of pivotable arm 9 is then rigidly connected to linear extending portion 45. This lower extending portion 45 extends linearly a sufficient distance in a generally horizontal plane so that the tip 7 at its end can be far enough from the upstanding portion 16 of the stand 1 to accommodate the football 5 at a point displaced from the stand itself. Thus, the base of the football 5 will be on the ground 3 at a sufficient distance from the tripod 11 so as that the football is free to be kicked by the kicker. In its preferred configuration as shown in FIG. 1, the knob 33 extends from the first cylindrical member 27 in a direction opposite to that of the football 5, and aligned with leg 13*a*. In this configuration, the device does not interfere with the football itself, or with the kicking process in particular.

Figure 2:
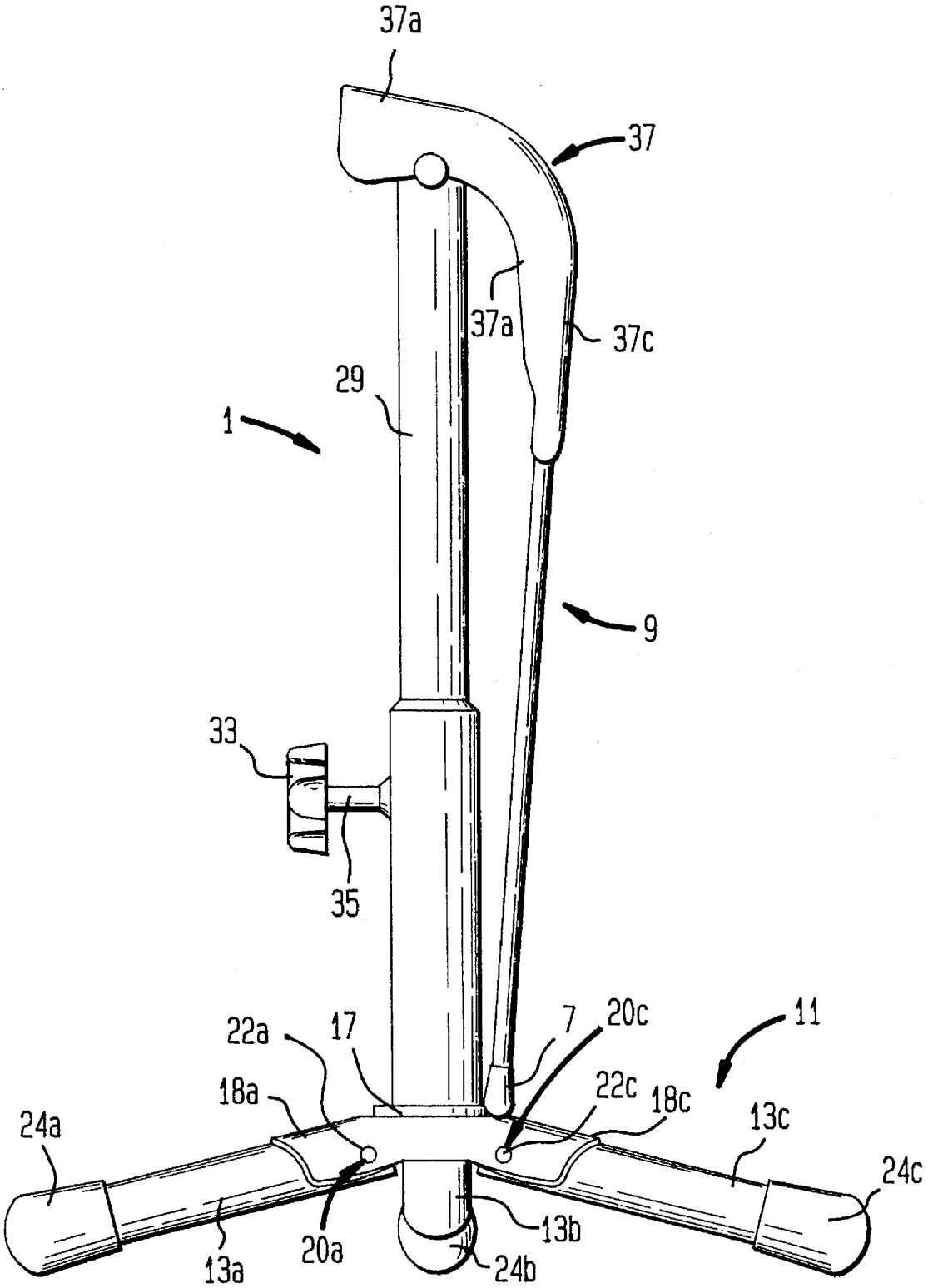
FIG. 2 is a side, elevational view of the football holding device of FIG. 1, in which, the pivotable arm is in the vertical downward position after use.

The pivotable arm 9 freely pivots about pivot point 40 from a generally horizontal position in which the curved portion 37*a* is fully engaged with the second cylindrical member 29, to a displaced horizontal position such as that shown in FIG. 1, in which the curved portion 37*a* is only slightly displaced from its fully mating configuration with the upper end of the second cylindrical portion 29, and finally, upon kicking of the football 5, into a vertical position such as that shown in FIG. 2. It is noted in this regard that the pivotable arm 9 can drop freely downwardly into the vertical position shown in FIG. 2 solely by the force of gravity. In this manner, it does not interfere with the kicker's kicking action, and immediately drops out of the horizontal plane after kicking. In addition, once the pivotable arm 9 is adjusted into the desired configuration for a football 5 in the manner shown in FIG. 1, it can also be utilized with a variety of smaller-sized footballs. Thus, the football 5 shown in FIG. 1 may be a regulation NFL-sized football, but the device set as shown in FIG. 1 could also be employed with smaller-, or junior-sized footballs, or even "NERF"-type footballs, without the need to readjust same.

The preferred configuration for the football holding device of the present invention is that shown in FIG. 1 hereof. In this configuration, the device 1 is extended by telescopically raising the second cylindrical member 29 to the height shown, and then locking by means of turning knob 33 until threaded portion 35 engages collar 31 and tightens second cylindrical member 29 thereagainst. At this elevation, the pivotable arm 9, when holding the football 5 in the position shown, is preferably at an angle $\alpha$ below the horizontal plane. This angle, preferably between about 1° and 15°, most preferably between about 1° and 10°, such as 5°, is significant in helping not only maintain the football 5 in its proper configuration for kicking, but in allowing the force of gravity to assist in that process, and in the dropping of the arm 9 into its vertical position as shown in FIG. 2 after the kick has been completed.

In this manner, the overall nature of the device of the football kicking device of the present invention can be seen in that it is a highly simplified structure which performs all the function of maintaining the football in the proper configuration just as would be done with another individual holding the football, but without requiring such a second person, and without interfering in any way with the kicker's action.

Figure 4:
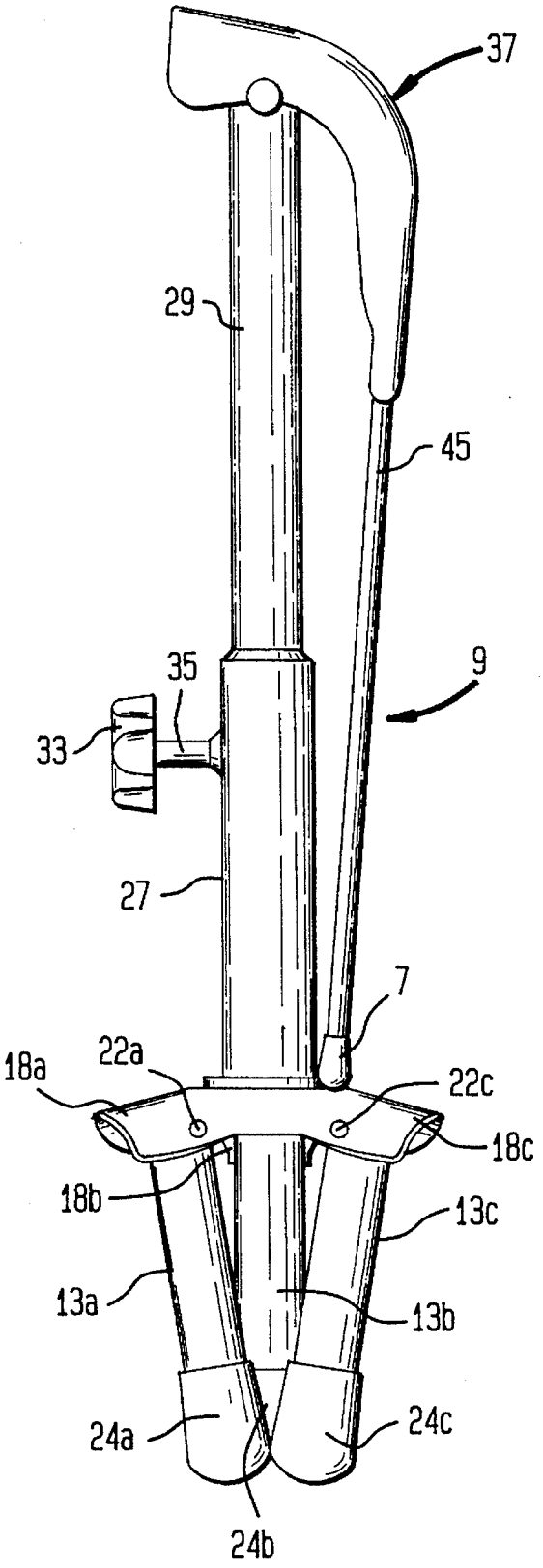
FIG. 4 is a side, elevational view of the football holding device of FIG. 1, in which the legs are folded into the storage position.
Figure 5:
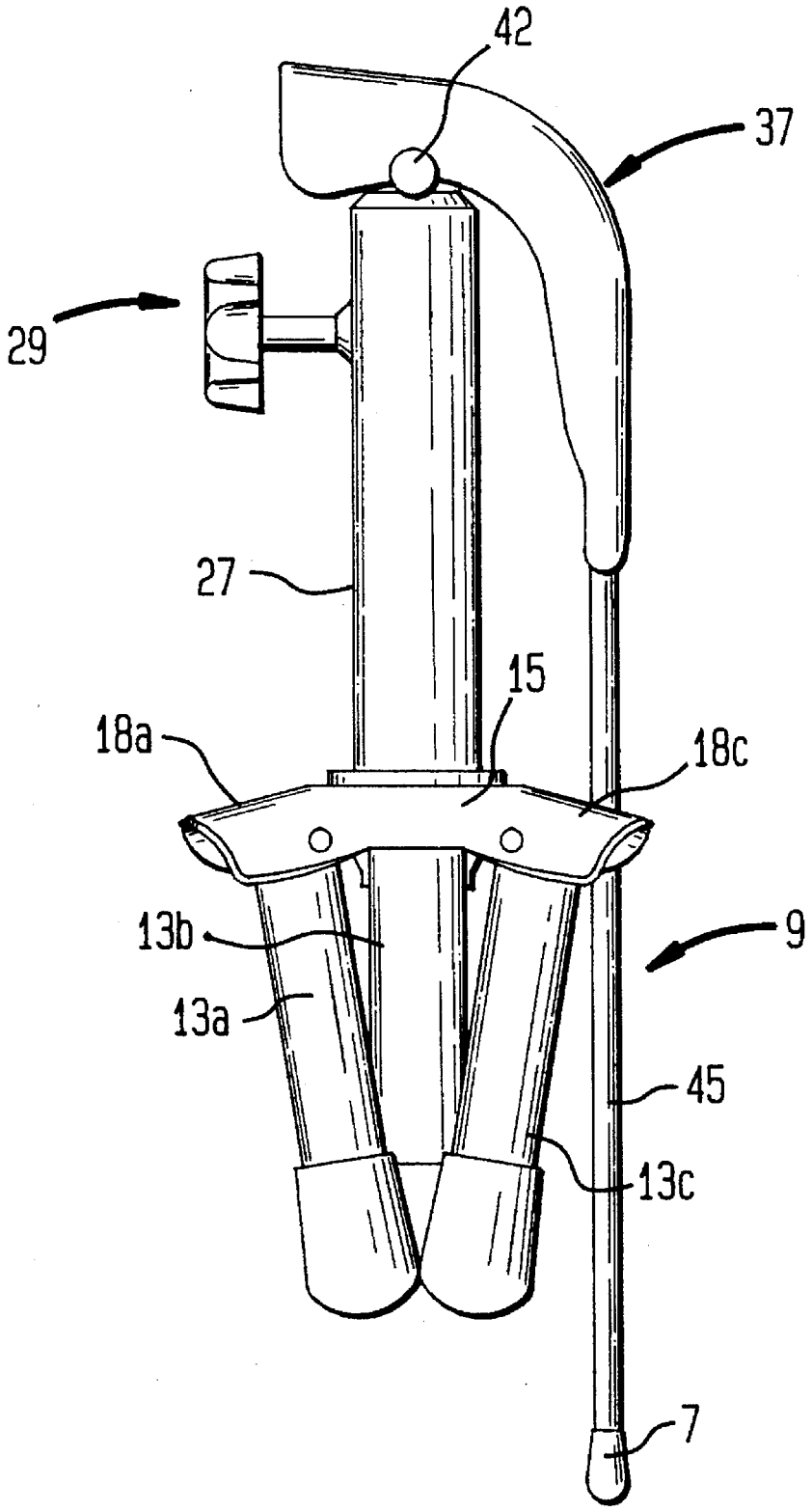
FIG. 5 is a side, elevational view of the football holding device of FIG. 1, in which the legs are folded into the storage position and the stand is collapsed for storage.

After use of the football holding device of the present invention, the device can be prepared for storage as follows:

Firstly, the legs 13*a, b* and *c* can be folded into the configuration shown in FIG. 4 by pivoting each leg inwardly about respective pivot points 20*a, b* and *c* defined by rivets 22*a, b* and *c* until the three rubber gripper pads 24*a, b* and *c* come into contact with each other. Furthermore, the device of this invention can be efficiently prepared for storage by telescoping second cylindrical member 29 into cylindrical member 27. This can be accomplished by loosening knob 33, thus permitting the second cylindrical portion 29 to slide downwardly into the configuration shown in FIG. 5, where it can be further tightened into that configuration by retightening knob 33 and extending threaded portion 35 thereof.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A football holding device for assisting in place kicking a football comprising stand means having a lower end for stable placement on the ground and an upper end, and a pivotable arm pivotally attached to said upper end of said stand means, said pivotable arm having a first end and a second end, said first end of said pivotable arm being pivotally attached to said upper end of said stand means and said second end of said pivotable arm being adapted for frictional engagement with one end of said football so as to maintain said football in a proper place kicking configuration, said pivotable arm rigidly extending from said first end to said second end and being freely swingable between a first portion wherein said pivotable arm extends substantially horizontally and a second position wherein said pivotable arm extends substantially vertical with respect to said first position, whereby said pivotable arm may hold said football in said place kicking configuration in said first position and can freely swing downwardly to said second position under the force of gravity upon said football being kicked.

2. The football holding device of claim 1 wherein the distance between said upper and lower ends of said stand means is greater than the length of said football, whereby said first position of said pivotable arm is displaced downwardly from the horizontal by an acute angle thereby permitting the force of gravity to assist in holding said football in said place kicking configuration.

3. The football holding device of claim 2 wherein said acute angle is between about 1° and 15° below horizontal.

4. The football holding device of claim 1 wherein said pivotable arm includes a first portion and a second portion angularly displaced with respect to said first portion, said first portion of said pivotable arm including pivotal attachment means for pivotal attachment to said upper end of said stand means and said second portion of said pivotable arm comprising the major portion of said pivotable arm and extending vertically downwardly when said pivotable arm is in said second position.

5. The football holding device of claim 1 wherein said stand means includes height adjustment means for varying the distance between said upper and lower ends of said stand means whereby said distance between said upper and lower ends of said stand means may be greater than the length of said football and said first position of said pivotable arm is displaced downwardly from the horizontal by an acute angle thereby permitting the force of gravity to assist in holding said football in said place kicking configuration.

6. The football holding device of claim 5 wherein said height adjustment means comprises telescoping first and second stand members and locking means for locking said first and second stand members in a desired position relative to each other.

7. The football holding device of claim 1 wherein said lower end of said stand means comprises a tripod.

8. The football holding device of claim 1 wherein said lower end of said stand means includes a plurality of leg members.

9. The football holding device of claim 8 wherein said plurality of leg members are pivotable between an open position wherein said football holding device can be in said stable placement on said ground and a storable closed position.

10. The football holding device of claim 1 wherein said second end of said pivotable arm includes friction tip means for frictionally engaging said football.

11. A football holding device for assisting in place kicking a football comprising stand means having a lower end for stable placement on a kicking surface and an upper end, a substantially rigid arm having a first end connected to said upper end of said stand means and a second end adapted for frictional engagement with one end of said football when said rigid arm is placed in a holding position so as to maintain the football in a proper place kicking configuration, and pivot means for pivotally connecting said first end of said substantially rigid arm to said upper end of said stand means and for allowing free swinging movement by the force of gravity of said substantially rigid arm from said holding position to a rest position wherein said second end of said substantially rigid arm is placed in a substantially vertical position relative to said kicking surface.

12. The football holding device of claim 11, wherein said holding position of said substantially rigid arm extends along a substantially horizontal plane.

13. The football holding device of claim 12, wherein the distance between said upper and lower ends of said stand means is greater than the length of said football, whereby said holding position of said substantially rigid arm is displaced downwardly from the substantially horizontal plane by a acute angle of between about 1° and 15°.

14. The football holding device of claim 11, wherein said stand means includes height adjustment means for varying the distance between said upper and lower ends of said stand means.

15. The football holding device of claim 14, wherein said height adjustment means comprises telescoping first and second stand members and locking means for locking said first and second stand members in a desired position relative to each other.

16. The football holding device of claim 11, wherein said lower end of said stand means comprises a tripod.

17. The football holding device of claim 11, wherein said lower end of said stand means includes a plurality of leg members.

18. The football holding device of claim 17, wherein said plurality of leg members are pivotable between an open position wherein said football holding device can be in said stable placement on said ground and a storable closed position.

19. The football holding device of claim 11, wherein said second end of said substantially rigid arm includes friction tip means for frictionally engaging said football.

* * * * *

UNITED STATES PATENT AND TRADEMARK OFFICE

CERTIFICATE OF CORRECTION

PATENT NO. : 5,553,855

DATED : September 10, 1996

INVENTOR(S) : Balestrieri

It is certified that error appears in the above-indentified patent and that said Letters Patent is hereby corrected as shown below:

Column 6, line 26, "portion" should read --position--.

Signed and Sealed this

Fourth Day of February, 1997

*Attest:*

Bruce Lehman

BRUCE LEHMAN

*Attesting Officer*

*Commissioner of Patents and Trademarks*